US011511906B2

(12) United States Patent
Downing

(10) Patent No.: US 11,511,906 B2
(45) Date of Patent: Nov. 29, 2022

(54) KEEPSAKE CREATION KIT AND METHOD

(71) Applicant: Michael Downing, Dartmouth, MA (US)

(72) Inventor: Michael Downing, Dartmouth, MA (US)

( * ) Notice: Subject to any disclaimer, the term of this patent is extended or adjusted under 35 U.S.C. 154(b) by 547 days.

(21) Appl. No.: 16/774,652

(22) Filed: Jan. 28, 2020

(65) Prior Publication Data

US 2020/0239183 A1 Jul. 30, 2020

Related U.S. Application Data

(60) Provisional application No. 62/798,179, filed on Jan. 29, 2019.

(51) Int. Cl.

| | |
|---|---|
| ***B65D 5/42*** | (2006.01) |
| ***C11C 5/02*** | (2006.01) |
| ***C11C 5/00*** | (2006.01) |
| ***F21V 35/00*** | (2006.01) |
| ***G09F 23/00*** | (2006.01) |

(52) U.S. Cl.
CPC ..... *B65D 5/4212* (2013.01); *C11C 5/008* (2013.01); *C11C 5/028* (2013.01); *F21V 35/00* (2013.01); *A47G 2400/061* (2013.01); *G09F 23/00* (2013.01)

(58) Field of Classification Search
CPC ..... B65D 5/42; B65D 5/4212; F21V 35/00; G09F 23/00; A47G 2400/061
USPC ..... 362/382; 206/575
See application file for complete search history.

(56) References Cited

U.S. PATENT DOCUMENTS

| | | | | |
|---|---|---|---|---|
| 3,077,981 | A * | 2/1963 | Gaspard | B65D 77/24 431/126 |
| 3,286,492 | A * | 11/1966 | Frazier, Jr. | F21V 37/00 431/126 |
| 6,978,887 | B1 * | 12/2005 | Bingham | B65D 5/542 206/86 |
| 2005/0079465 | A1 * | 4/2005 | Tillieux | C11C 5/008 431/288 |
| 2016/0223191 | A1 * | 8/2016 | Porada | F23D 3/16 |
| 2019/0338943 | A1 * | 11/2019 | Putnam | C11C 5/006 |
| 2021/0304647 | A1 * | 9/2021 | Bernstein | G09F 23/00 |

* cited by examiner

*Primary Examiner* — Laura K Tso
(74) *Attorney, Agent, or Firm* — Douglas Denninger

(57) ABSTRACT

A kit enabling creation of a personal keepsake by at least one user and methods of using same. A first container is openable by a user, and a plurality of candles are enclosed in the first container. Each candle has a wick at one end and an opposite end having a base width. The kit further includes a second container which is openable by the user, and a plurality of tubes enclosed in the second container. Each tube has at least one end which is initially open and defines a chamber having a chamber width and a chamber length to receive a storage medium, the initially open end adapted to receive the base width of one of the candles.

18 Claims, 3 Drawing Sheets

KEEPSAKE CREATION KIT AND METHOD

CROSS-REFERENCE TO RELATED APPLICATION

This application claims priority to U.S. Provisional Application No. 62/798,179 filed on 29 Jan. 2019. The entire contents of the above-mentioned application are incorporated herein by reference.

FIELD OF THE INVENTION

This invention relates to devices and methods for memorializing events by creating personal memorabilia and, more specifically, to a do-it-yourself kit and method to commemorate a life event by creating a keepsake to be opened at a later date.

BACKGROUND OF THE INVENTION

Life events such as birthdays and child-births, graduations, first communions and other religious ceremonies, marriages, recoveries from illness or surgeries, and sports victories are generally commemorated by selecting among greeting cards or souvenirs offered by mass-marketing entities such as publishers, souvenir makers, and ring manufacturers. With such "generic" products, however, the customer depends on the manufacturer or vendor to provide a suitable "message" which communicates a desired sentiment or expression of thought.

It can be time-consuming and frustrating to search for an appropriate product that expresses exactly what the customer is feeling or thinking and would like to convey. Additionally, most physical products simply convey a single message.

It is therefore desirable to facilitate creation of a personalized, physical keepsake which exactly reflects the customer's personal message to another person or to herself or himself at a later point in time.

SUMMARY OF THE INVENTION

An object of the present invention is to provide a kit and method to enable a person to prepare and preserve a customized message within a tube for review at a later date.

Another object of the present invention is to provide such a kit and method which may accommodate multiple events and/or multiple users for future review.

The term "tube" is utilized herein in its broadest meaning of a structure having at least one wall defining an inner chamber having a volume.

The term "container" is utilized herein in its broadest meaning of an initially closed vessel or package that holds items such as tubes or candles in kits according to the present invention.

This invention features a kit enabling creation of a personal keepsake by at least one user, including a first container which is openable by a user, and a plurality of candles enclosed in the first container. Each candle has a wick at one end and an opposite end having a base width. The kit further includes a second container which is openable by the user, and a plurality of tubes enclosed in the second container. Each tube has at least one end which is initially open and defines a chamber having a chamber width and a chamber length to receive a storage medium. The initially open end of each tube is adapted to receive the base width of one of the candles after a storage medium is inserted into the chamber.

In a number of embodiments, the kit further includes at least one storage medium to record a message by a user. In some embodiments, the at least one storage medium is sized larger in width than the chamber and is sufficiently flexible to be bent or folded for insertion into the chamber. In certain embodiments, a plurality of slips of writing material serve as storage media.

In some embodiments, at least one of the plurality of tubes is cylindrical and the width of the chamber is an internal diameter of the tube. In other embodiments, at least one of the tubes has a plurality of sides. In certain embodiments, at least one of the plurality of tubes is fabricated of a material which enables human visual perception of the storage medium when placed in the tube. In some embodiments, the kit further includes at least one tool such as tweezers suitable to grasp one of the storage media after insertion into one of the tubes.

This invention also features a method of creating a personal keepsake for a user, including selecting a candle having a wick at one end and an opposite end having a base width, and selecting a tube having at least one end which is initially open and defines a chamber having a chamber width and a chamber length to receive a storage medium. The method further includes selecting a storage medium, recording a message relating to the user on the storage medium, and placing the storage medium through the initially open end into the chamber, either together with or prior to placing the base end of the candle into the initially open end of the tube to secure the storage medium within the chamber.

In some embodiments, the tube is selected to have the initially open end of the tube adapted to receive the base width of the candle together with the storage medium wrapped around a portion of the candle as a message assembly. In other embodiments, placing the base end of the candle into the initially open end includes modifying the base width of the candle to fit within the tube. In one embodiment, recording a message includes writing the message on a piece of paper.

In certain embodiments, the storage medium has an overall size including a width that is greater than the chamber width, and placing the storage medium includes reducing the overall size of the storage medium to a width that is no greater than the chamber width, such as by curling, rolling and/or folding a piece of paper on which the message is written, and then inserting the storage medium into the chamber while it has the reduced overall size. In some embodiments, placing the storage medium includes manipulating the storage medium such that the message is not visible through the tube after the storage medium is secured within the chamber. In certain embodiments, the storage medium is sized, and is made of a sufficiently flexible material, such that it can be curled around the base of a candle and inserted, together with the candle base, into one of the tubes. By curling the slip with the message side facing toward the candle, one can temporarily hide the content of the message until the candle and message slip are later removed from the tube. In one embodiment, the candle is selected to have at least one visually perceptible indicia such as a color or type of striping that is unique to the user.

BRIEF DESCRIPTION OF THE DRAWINGS

In what follows, preferred embodiments of the invention are explained in more detail with reference to the drawings, in which.

DETAILED DESCRIPTION OF THE PRESENTLY PREFERRED EMBODIMENTS

This invention may be accomplished by a kit enabling creation of a personal keepsake by at least one user, and methods of using such kits. A first container is openable by a user, and a plurality of candles are enclosed in the first container. Each candle has a wick at one end and an opposite end having a base width. The kit further includes a second container which is openable by the user, and a plurality of tubes enclosed in the second container. Each tube has at least one end which is initially open and defines a chamber having a chamber width and a chamber length to receive a storage medium, the initially open end adapted to receive the base width of one of the candles after the storage medium is inserted into the chamber.

This invention may also be expressed as a do-it-yourself kit, and methods of using same, which permits a person to write his or her own message and to preserve it, to be reviewed at another time and/or place. In a presently preferred construction, the kit includes a plurality of small candles, such as those conventionally placed on birthday cakes, and a corresponding number of tubes such as transparent-walled cylinders, each of which is sized to receive a portion of a candle. The kit further includes a number of pieces of paper or other storage media, preferably rectangular slips of paper or similar writing media, sized such that a slip of paper can be curled around the base of a candle and inserted, together with the candle base, into one of the tubes. By curling the slip with the message side facing toward the candle, one can temporarily hide the content of the message until the candle and message slip are later removed from the tube. A tangible keepsake is thereby provided for later enjoyment.

Tubes utilizable according to the present invention are structures having at least one wall defining an inner chamber having a volume. Tubes include cylinders made of glass or polymeric material having a cylindrical wall which is open at only one end in some constructions and, in other constructions, is open at a first end and is closed at an opposite end. Tubes also include structures having three or more sidewalls which define the inner chamber. In some constructions the tube is fabricated from a transparent or translucent material and, in other constructions, is fabricated from an opaque material.

Containers utilized according to the present invention are initially closed vessels or packages that hold items such as tubes or candles in kits according to the present invention. Examples of containers include cartons, boxes, and/or polymeric packages including initially sealed bags and pouches. In some constructions, the container is resealable such as having flaps or tabs that can be resealed by a user. In other constructions, it is simply opened once by a user such as by cutting open or pulling open an initially sealed bag; of course, a closure device such as a clip or piece of tape can be utilized by a user to re-seal the bag.

Figure 1:
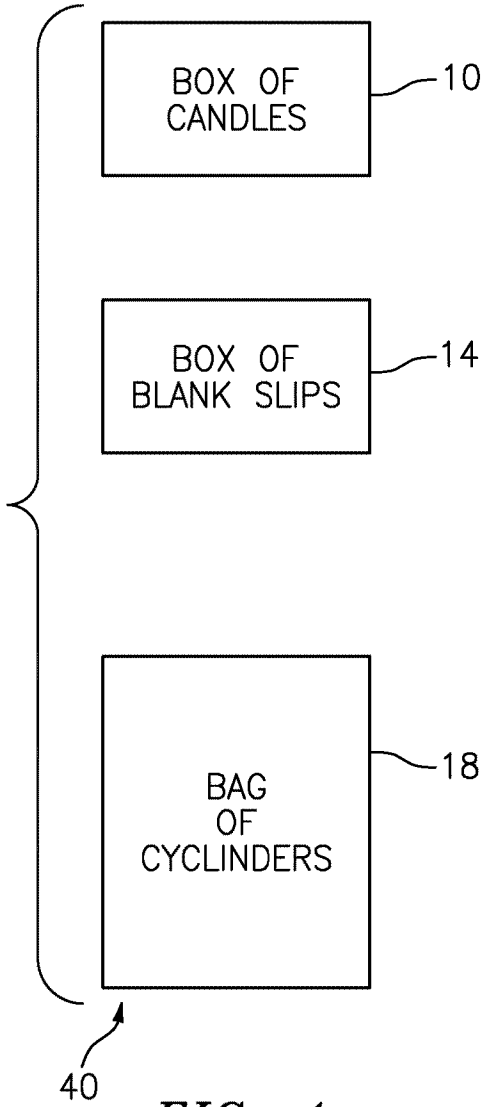
FIG. 1 is a schematic diagram of a kit according to one aspect of the present invention having three containers of items.
Figure 6A:
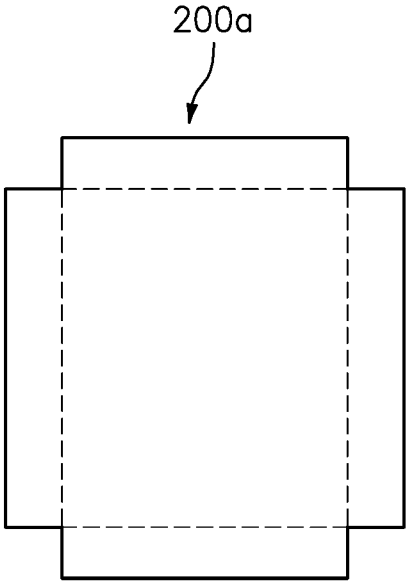
FIGS. 6A and 6B are schematic top views of a lid and a body of a keepsake storage box, respectively according to the present invention prior to assembly.
Figure 6B:
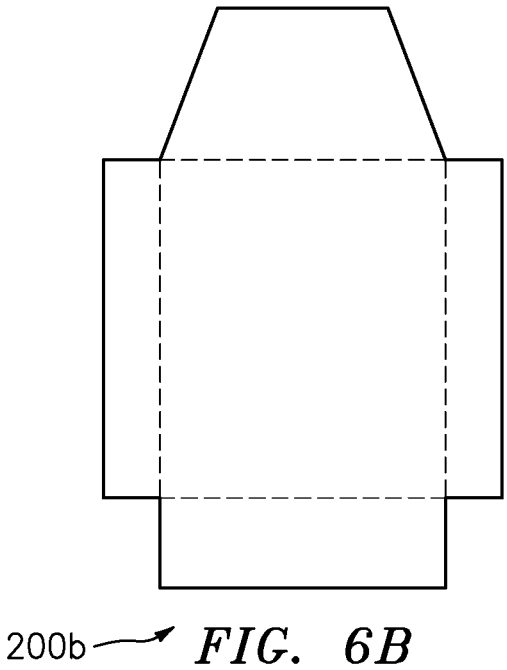

Kit 40, FIG. 1, includes a box 10 of candles, a box 14 of blank slips of paper as storage media, and a bag 18 of tubes such as cylinders. In one construction, kit 40 is contained within an outer package 100, FIG. 5, and may further include an individual keepsake box to be assembled by a customer from an upper lid 200*a*, FIG. 6A and a lower carton 200*b*, FIG. 6B. In one construction, at least one tool such as tweezers (not shown), suitable to grasp one of the storage media after insertion into one of the tubes, is included in kit 40.

Figure 2A:
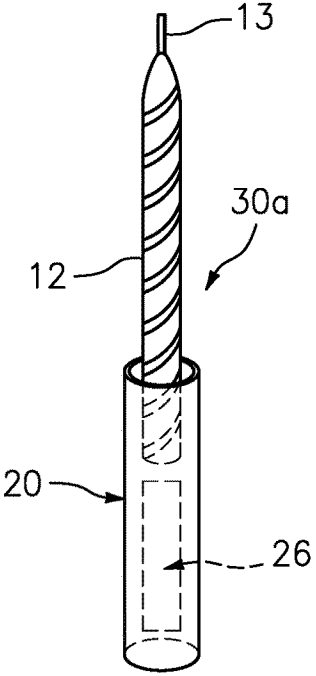
FIG. 2A is a schematic side view of one message assembly according to the present invention having a storage medium with recorded message placed within a cylinder and sealed with a candle.

One message assembly 30*a* according to the present invention, FIG. 2A, has a storage medium 26 with recorded message placed within a cylinder 20 and sealed with a candle 12 having a wick 13. The candle 12 and cylinder 20 of FIG. 2A are shown spaced apart from each other in FIG. 2B. Candle 12 has a base end 15 with an initial base width BW. In some constructions, the candles in the kit have different colors or other tactile or visually perceptible indicia. The candle 12 may be selected to have at least one visually perceptible indicia such as a color or type of striping that is unique to a particular user or to a category of event.

Figure 2B:
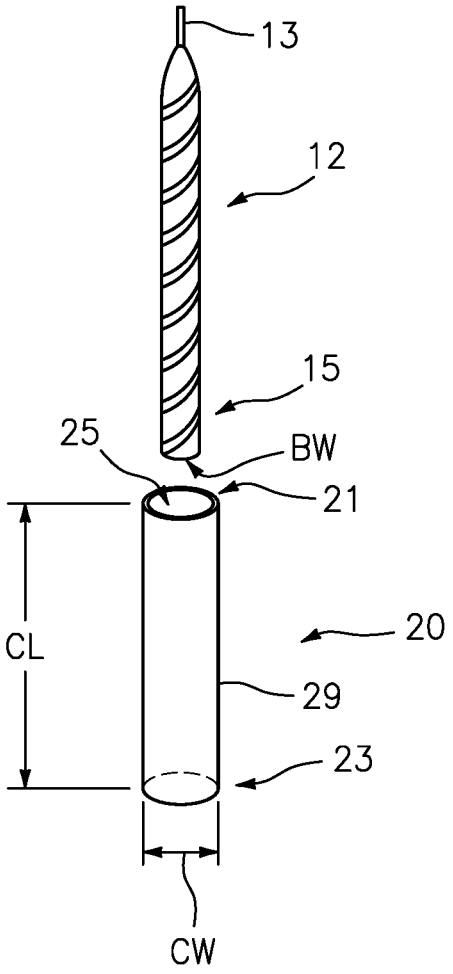
FIG. 2B is an expanded view of the candle and cylinder of FIG. 2A.

Cylinder 20, FIG. 2B, has a first, initially open end 21 and a second end 23 which is also initially open in some constructions and, in other constructions, is closed when provided in the kit 40. A single cylindrical wall 29 extends between the ends 21, 23 in this construction and defines a chamber 25 having a volume defined by chamber width CW (which is a inner diameter in this construction) and a chamber length CL.

Figure 3A:
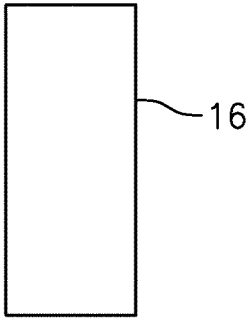
FIG. 3A is a schematic top view of a blank slip of paper.
Figure 3B:
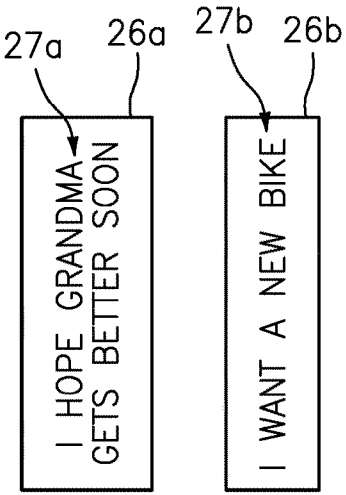
FIG. 3B illustrates the slip of paper of FIG. 3A with different messages recorded thereon.

A blank slip of paper 16, FIG. 3A, is schematically illustrated in FIG. 3B with different messages 27*a* recorded thereon as a recorded message medium 26*a* and a message 27*b* as a recorded message medium 26*b*.

Figure 4:
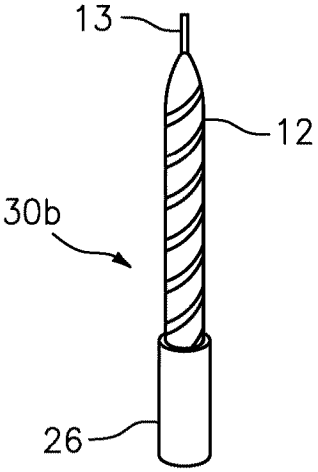
FIG. 4 is a schematic side view of a candle with a message slip wrapped around it to form another type of a message assembly prior to insertion into a cylinder according to the present invention.

FIG. 4 is a schematic side view of candle 12 with a message slip 26 wrapped around it to form another type of a message assembly 30*b* prior to insertion into a cylinder according to the present invention.

Figure 5:
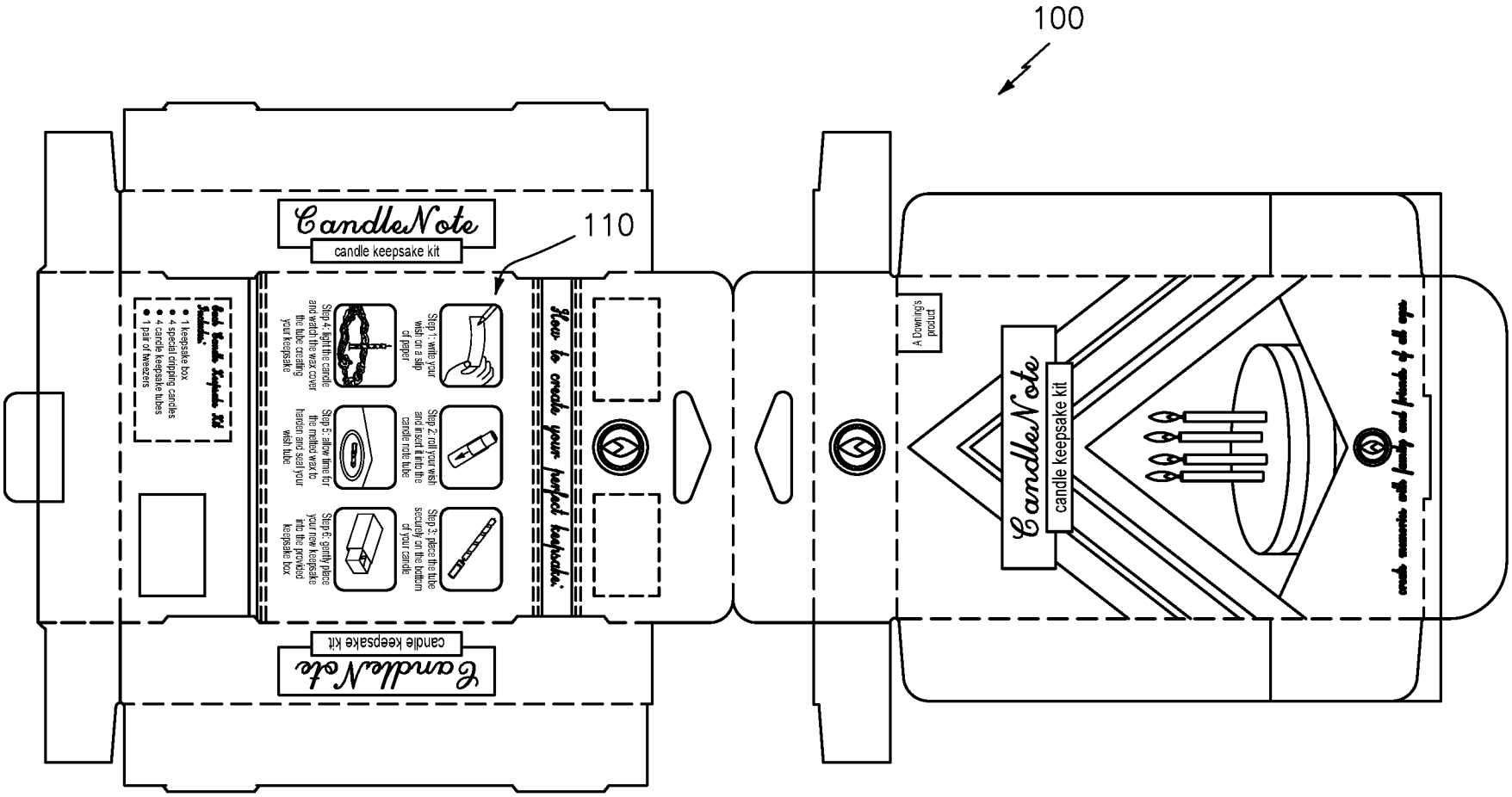
FIG. 5 is a schematic top view of a kit box according to the present invention prior to assembly.

FIG. 5 is a schematic top view of a kit box 100 according to the present invention prior to assembly. Instructions 110 are described in more detail below. In some constructions, one or more of kit box 100, lid 200*a* and/or lower carton 200*b*, FIGS. 6A-6B, encourage one or more users to record candle color, date and/or event on the packaging to remind the users what events have been memorialized. When different types of candles are included in the kit, a user can select his or her candle to have at least one visually perceptible indicia such as a color or type of striping that is unique to the user.

In a first step according to one aspect of the present invention, the customer or other user retrieves a blank slip 16 from box 14, FIG. 1, and writes a personal message or wish on it, thereby creating a message strip 26, FIGS. 2A and 4, which recites a message such as "I hope Grandma gets better soon", message 27*a* on message strip 26*a*, FIG. 3B, or "I want a new bike", message 27*b* on message strip 26*b*, or any other desired sentiment. As further examples, the sentiment can commemorate a 1st birthday of a child, a prayer, or a milestone event such as a "sweet 16" birthday of a daughter or a child's winning a sporting event or an educational challenge.

In a second step, the completed message strip 26 is curled around the base 15, FIG. 2B, of a candle 12, also referred to herein as a "wick-remote end" 15 of a candle 12, and the thus-created assembly 30*b*, FIG. 4, of candle and message, also referred to herein as a "message assembly", is slipped axially into the open end of a tube such as transparent cylinder 20. Alternatively, the message strip 26 is simply placed in a cylinder 20, FIG. 2A, and then sealed inside by a candle 12. As previously noted, the blank side of the message strip is placed to face outwards in one technique according to the present invention, so that the message is not visible through the transparent cylinder 20; the presence of the message strip, however, can be visually confirmed and verified at any time by looking through the transparent wall 29 of the cylinder 20 in this construction.

If desired, the completed keepsake can be placed back into a carton initially containing the kit or into another appropriately-sized keepsake container, such as a box assembled from upper lid 200*a* and lower carton 200*b*, shown before assembly in FIGS. 6A-6B, respectively. Alternatively, the keepsake assembly can be placed in a small box conventionally utilized to store bracelets, cameos or other valuables.

In a third step, to be performed at a different time and/or place, the candle is removed from the cylinder, the message is uncurled and read, and the candle can be lighted and burned to commemorate the occasion.

The outer package 100, FIG. 5, in one construction according to the present invention, initially contains the kit illustrated in FIG. 1 plus an inner keepsake container such as a small box described above in relation to FIGS. 6A and 6B. In this construction, glass tube 20, FIG. 1, is a cylinder having one open end with the opposite end closed. Instructions 110, FIG. 5, describe six steps according to one embodiment of the present invention. Step 1: write your wish on a strip of paper. Step 2: roll your wish and insert it into the open end of the candle note tube. Step 3: place the open end of the tube securely on the bottom of your candle. Step 4: light the candle and watch the wax cover at least a portion of the tube. Step 5: allow time for the melted wax to harden, thereby creating a sealed keepsake, also referred to as a wish tube. Step 6: gently place your new keepsake into the provided keepsake box, FIGS. 6A-6B, after assembling it.

Although specific features of the present invention are shown in some drawings and not in others, this is for convenience only, as each feature may be combined with any or all of the other features in accordance with the invention. While there have been shown, described, and pointed out fundamental novel features of the invention as applied to a preferred embodiment thereof, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps that perform substantially the same function, in substantially the same way, to achieve the same results be within the scope of the invention. Substitutions of elements from one described embodiment to another are also fully intended and contemplated. It is also to be understood that the drawings are not necessarily drawn to scale, but that they are merely conceptual in nature.

It is the intention, therefore, to be limited only as indicated by the scope of the claims appended hereto. Other embodiments will occur to those skilled in the art after reviewing the present disclosure and are within the following claims.

What is claimed is:

1. A kit enabling creation of a personal keepsake by at least one user, comprising:

a first container which is openable by a user;

a plurality of candles enclosed in the first container, each candle having a wick at one end and an opposite end having a base width;

a second container which is openable by the user; and a plurality of tubes enclosed in the second container, each tube having at least one end which is open and defining a chamber having a chamber width and a chamber length to receive a storage medium, the initially open end being adapted to receive the base width of one of the candles.

2. The kit of claim 1 further including at least one storage medium to record a message by a user.

3. The kit of claim 2 wherein the at least one storage medium is sized larger in width than the chamber and is sufficiently flexible to be bent or folded for insertion into the chamber.

4. The kit of claim 1 further including a plurality of slips of writing material, each slip of writing material suitable to record a message by a user.

5. The kit of claim 1 wherein at least one of the plurality of tubes is cylindrical and the width of the chamber is an internal diameter of the tube.

6. The kit of claim 1 wherein at least one of the plurality of tubes is fabricated of a material which enables human visual perception of the storage medium when placed in the tube.

7. A kit enabling creation of a personal keepsake by at least one user, comprising:

a first container which is openable by a user and contains a plurality of candles in the first container, each candle having a wick at one end and an opposite end having a base width;

a second container which is openable by the user and contains a plurality of tubes, each tube having at least one end which is open and defining a chamber having a chamber width and a chamber length to receive a storage medium, the initially open end being adapted to receive the base width of one of the candles after the storage medium is inserted therein; and a plurality of storage media, each storage medium adapted to record a message by a user.

8. The kit of claim 7 wherein at least one of the storage media is sized larger in width than the chamber and is sufficiently flexible to be bent or folded for insertion into the chamber.

9. The kit of claim 7 wherein a plurality of slips of writing material serve as storage media.

10. The kit of claim 9 wherein at least one of the plurality of tubes is cylindrical, the width of the chamber is an internal diameter of the tube, and a second end of the tube opposite to the initially open end is closed.

11. The kit of claim 10 wherein at least one of the plurality of tubes is fabricated of a material which enables human visual perception of one of the storage media when placed in the tube.

12. A method of creating a personal keepsake for a user, comprising:

selecting a candle having a wick at one end and an opposite end having a base width;

selecting a tube having at least one end which is initially open and defines a chamber having a chamber width and a chamber length to receive a storage medium;

selecting a storage medium;

recording a message relating to the user on the storage medium; and placing the storage medium through the initially open end into the chamber and placing the base end of the candle into the initially open end of the tube to secure the storage medium within the chamber.

13. The method of claim 12 wherein the tube is selected to have the initially open end of the tube adapted to receive the base width of the candle together with the storage medium wrapped around a portion of the candle as a message assembly.

14. The method of claim 12 wherein placing the base end of the candle into the initially open end includes modifying the base width of the candle to fit within the tube.

15. The method of claim 12 wherein recording a message includes writing the message on a piece of paper and then at least one of (1) curling the paper around a portion of the candle prior to placing the base end of the candle into the chamber or (2) folding the paper around a portion of the candle prior to placing the base end of the candle into the chamber.

16. The method of claim 12 wherein the storage medium has an overall size including a width that is greater than the chamber width, and placing the storage medium includes reducing the overall size of the storage medium to a width that is no greater than the chamber width when inserting the storage medium into the chamber.

17. The method of claim 16 wherein placing the storage medium includes manipulating the storage medium such that the message is not visible through the tube after the storage medium is secured within the chamber.

18. The method of claim 12 wherein the candle is selected to have a color that is unique to the user.

* * * * *